US005143364A

United States Patent [19]

Kharzo et al.

[11] Patent Number: 5,143,364

[45] Date of Patent: Sep. 1, 1992

[54] SUCTION CONTROL SYSTEM FOR PRINTING OR DUPLICATING MACHINES

[75] Inventors: Joseph S. Kharzo, Chicago; David W. Grostick, Barrington; Jiann-Shing Liang, Mount Prospect; Narasimha Swamy, Streamwood, all of Ill.

[73] Assignee: AM International, Inc., Chicago, Ill.

[21] Appl. No.: 638,937

[22] Filed: Jan. 9, 1991

[51] Int. Cl.[5] ..... B65H 3/08

[52] U.S. Cl. ..... 271/108; 271/107

[58] Field of Search ..... 271/96, 98, 108, 107

[56] References Cited

U.S. PATENT DOCUMENTS

| | | | |
|---|---|---|---|
| 1,736,483 | 11/1929 | Broadmeyer | 271/96 |
| 4,391,439 | 7/1983 | Edström | 271/108 |
| 4,589,645 | 5/1986 | Tracy | 271/98 |
| 5,076,559 | 12/1991 | Lawniczak | 271/98 |

FOREIGN PATENT DOCUMENTS

| | | | |
|---|---|---|---|
| 117139 | 5/1989 | Japan | 271/98 |
| 288538 | 11/1989 | Japan | 271/98 |

OTHER PUBLICATIONS

Wenthe, Jr., Stephen J., "Stack Weight Sensing Tray", *Xerox Disclosure Journal.* vol. 7, No. 4, pp. 229. (Jul.-/Aug. 1982).

*Primary Examiner*—Robert P. Olszewski
*Assistant Examiner*—Steven M. Reiss
*Attorney, Agent, or Firm*—Wood, Phillips, Van Santen, Hoffman & Ertell

[57] ABSTRACT

A printing or duplicating machine has a suction control system which includes a source of vacuum and a conduit connecting the source of vacuum to a suction feeder. An operator panel is used to set a pattern of relative weight of each sheet in a stack. A controlled bleed valve is operatively associated with any of the suction feeder, source of vacuum or conduit for automatically adjusting vacuum at the suction feeder responsive to relative weight of any given sheet as selected by an operator.

18 Claims, 6 Drawing Sheets

Fig. 1
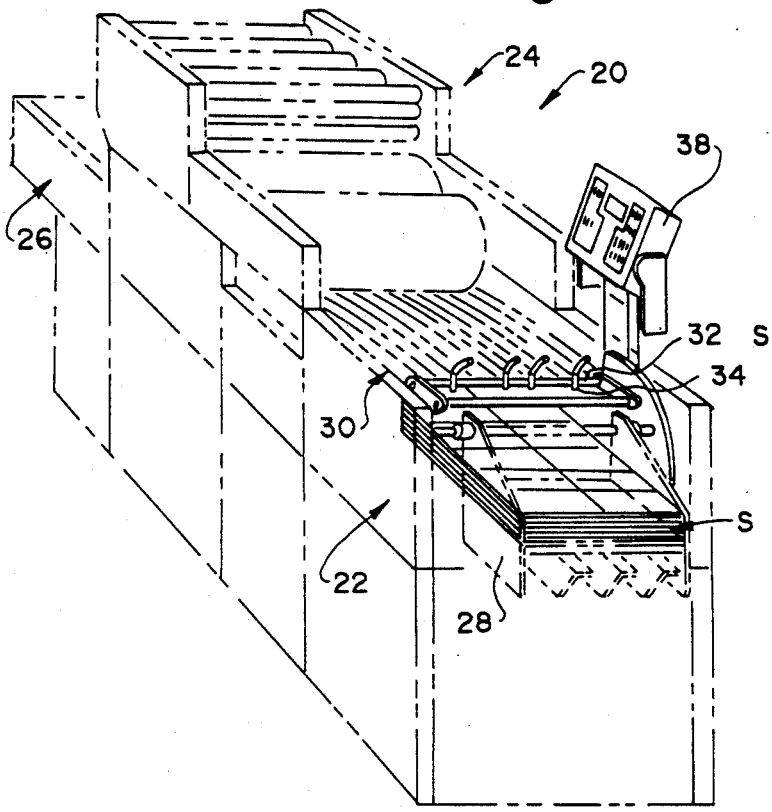
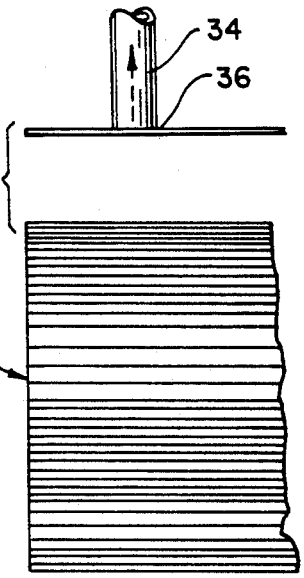
Fig. 2
Fig. 3
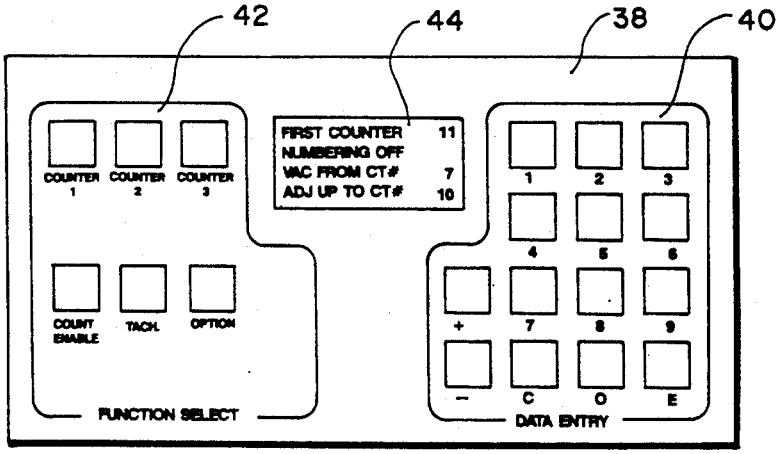

Fig. 4
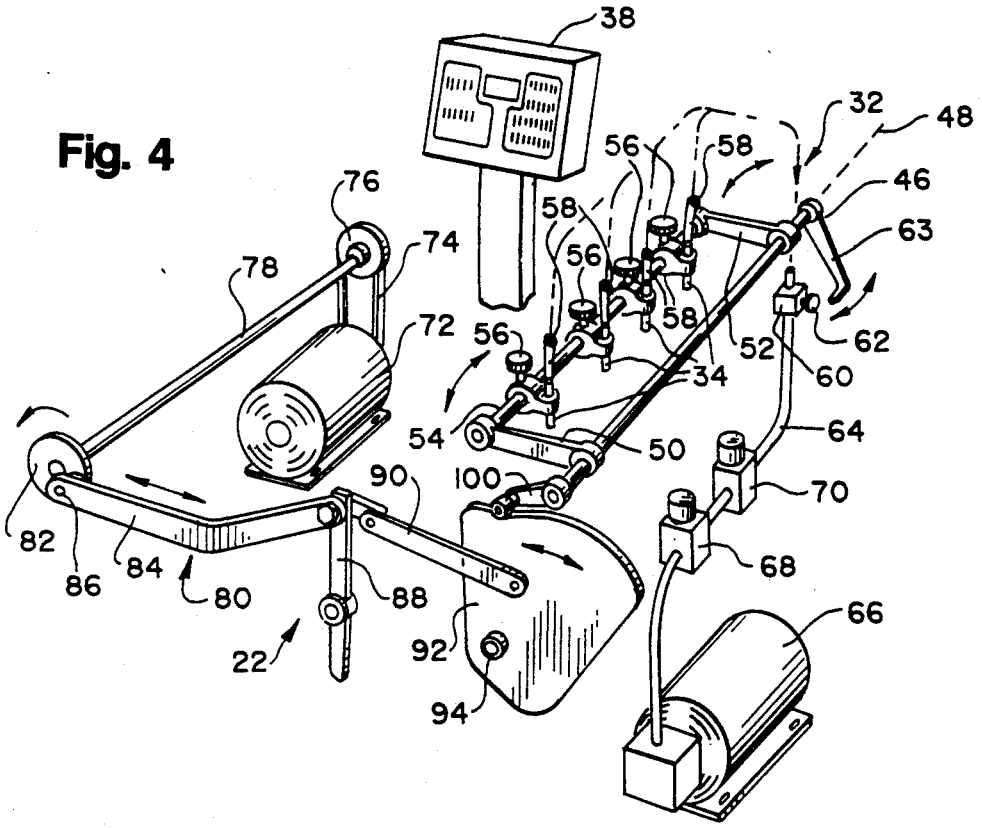
Fig. 5
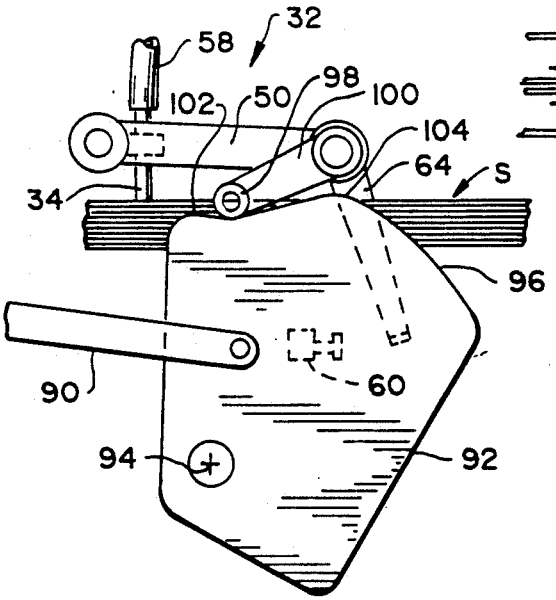
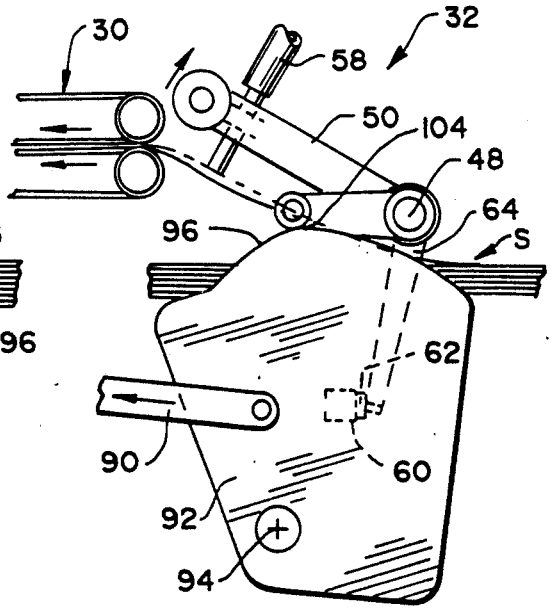
Fig. 6

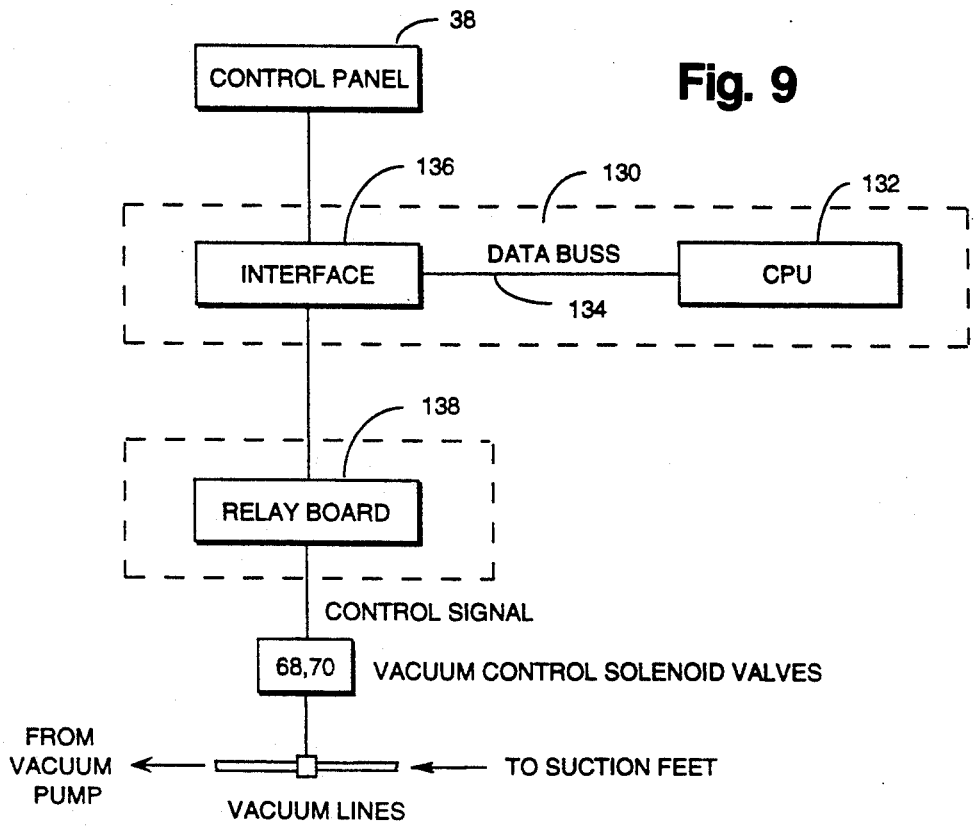
Fig. 9
Fig. 10
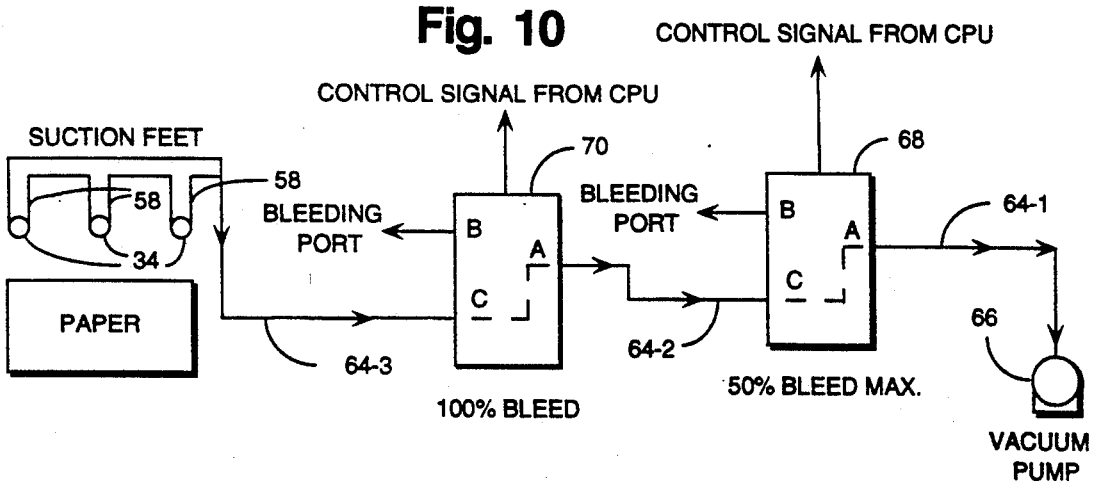

SUCTION CONTROL SYSTEM FOR PRINTING OR DUPLICATING MACHINES

FIELD OF THE INVENTION

This invention relates generally to printing or duplicating machines and, more particularly, to a suction control system for automatically adjusting vacuum in response to paper weight.

BACKGROUND OF THE INVENTION

Printing machines normally include a printing couple which comprises a number of cylinders and/or rollers. A stack of sheets is stored at a feed end of the machine with a reciprocating suction feed assembly being used to deliver the sheets seriatim to the printing couple. In such printing machines a vacuum pump is coupled to the suction feed to lift the top sheet in the stack and the suction feed is mechanically driven to deliver the lifted sheets to a conveyor structure which carries the sheet to the printing couple. Once the sheet is so delivered, a vacuum release is actuated to release the vacuum at the suction feed to release the sheet.

One of the problems with feeding systems in machines of the character described is the inability to account for different weight stock. Vacuum can be selected to effectively operate for a single given weight of stock. If the stock is heavier, then the suction might be insufficient to lift the sheet. Conversely, if the stock were lighter, then the suction feeder could pick up multiple sheets or the sheets could buckle.

The problem is compounded when stock of different weights is provided in a single stack which is to be printed during a single run. Heretofore, in such a situation it is necessary to select a given level of vacuum and hope for minimal doubles and misfeeding problems, or periodically shut the machine off during a single run to adjust vacuum. Both alternatives are, of course, undesirable.

The present invention is directed to solving one or more of the problems discussed above.

SUMMARY OF THE INVENTION

It is an object of the invention to provide a novel suction control system in a printing, duplicating or like machine.

Broadly, the suction control system includes a source of vacuum and a conduit connecting the source of vacuum to a suction feeder. An input means determines relative weight of any given sheet in a stack. A control means is operatively associated with any of the suction feeder, source of vacuum or conduit for automatically adjusting vacuum at the suction feeder responsive to relative weight of any given sheet as determined by the input means.

It is a feature of the invention that the input means comprises an operator panel.

It is another feature of the invention that the input means comprises a presettable counter means for entering a count value representing a quantity of sheets at a relatively high weight and a quantity of sheets at a relatively low weight.

It is a further feature of the invention that the control means comprises a bleed valve coupled in the conduit. Particularly, the control means comprises a solenoid linked to the bleed valve for operating the same, and the bleed valve reduces vacuum applied at the suction feeder by a preselected amount. More particularly, the bleed valve includes a plunger, and plunger movement is selected to provide the preselected amount of vacuum reduction.

Further features and advantages of the invention will readily be apparent from the specification and from the drawings.

BRIEF DESCRIPTION OF THE DRAWINGS

FIG. 1 is a somewhat schematic perspective view of a printing or duplicating machine using a suction control system according to the invention;

FIG. 2 is a detailed plan view illustrating a suction foot of the machine of FIG. 1 lifting a sheet from a stack;

FIG. 3 is a plan view illustrating the face of an operator panel for the machine of FIG. 1;

FIG. 4 is a partial perspective of the machine of FIG. 1 illustrating only those parts used in connection with the suction control system of the invention;

FIG. 5 is a detailed plan view showing the suction feeder of FIG. 4 at the start of a sheet feed cycle;

FIG. 6 is a detailed plan view showing the suction feeder of FIG. 4 at the end of a sheet feed cycle;

FIG. 9 is a block diagram of an electrical control for the suction control system of the invention;

FIG. 10 is a hydraulic schematic for the suction control system of the invention;

DESCRIPTION OF THE INVENTION

Figure 7:
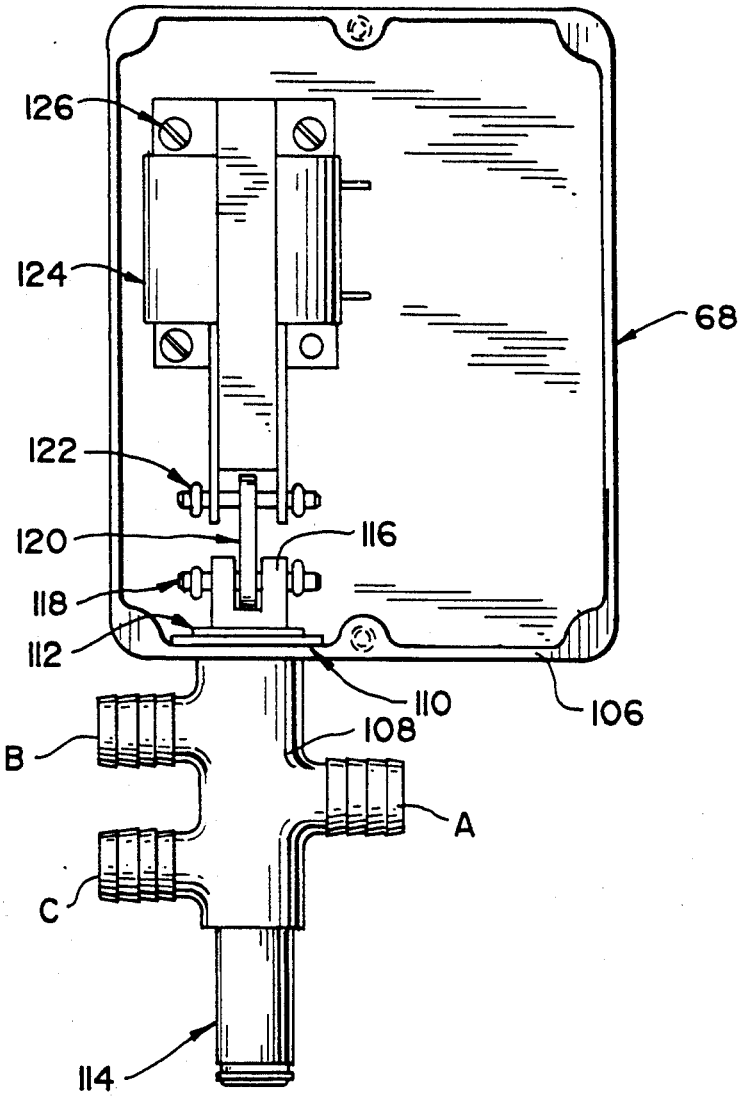
FIG. 7 is a plan view illustrating a bleed valve of the machine of FIG. 1.

With reference to FIG. 1, the invention is illustrated herein for use in a printing, duplicating or like machine, generally designated 20, which includes a sheet feeding end 22, a printing couple 24, and an imaged copy exiting end 26. The sheet feeding end 22 includes a tray assembly 28 which holds a stack of sheets to be fed seriatim to a conveyor 30. The conveyor 30 delivers the individual sheets to the printing couple 24. The printing couple 24 includes conventional impression cylinders, blanket cylinders, and master or plate cylinders. The copy sheets which have images produced on one or both sides are stacked at the exiting end 26 as is conventional with most printing or duplicating machines.

The printing or duplicating machine 20 may be such as a rotary offset lithographic machine which includes an ink fountain for feeding ink to various distribution rollers of the printing couple which transfer images to copy sheets. In addition, a moisture fountain is disposed adjacent the printing couple for feeding moisture to the printing couple through a path defined by the distribution rollers.

With reference also to FIG. 2, a stack of sheets S are supported in the tray 28. In order to deliver sheets S to the conveyor 30, a suction feeder 32 lifts the top sheet in the stack and moves it to the conveyor 30. The suction feeder 32 includes a plurality of suction feet 34, one of which is shown in FIG. 2. The suction feet 34 comprise cylindrical tubes having open ends 36. The vacuum pressure at the open end 36 lifts the top sheet off the stack and the suction feeder 32 is subsequently moved from a position adjacent the stack to a position adjacent the conveyor 30, as discussed below.

In certain applications, sheet stock of different weights may be included in a stack. For example, in a check printing operation, three different types of stock may be utilized. These three include card stock, which is relative heavy, check stock which is relative lighter, and copy stock which is lighter yet. If vacuum pressure were adjusted for copy stock, then the feet 34 could not pick up card stock. Conversely, if vacuum pressure were adjusted for card stock, then the feet 34 would likely pick up multiple sheets of copy stock, or the sheets might buckle. In accordance with the invention, a suction control system is provided which automatically adjusts vacuum pressure at the suction feet 34 responsive to relative weight of any given sheet.

In a given printing application, the pattern of sheets stacked on the tray 28 is generally known. This pattern can be used to input to a control system requirements for adjusting vacuum, as discussed below.

In order to command operation, the printing or duplicating machine 20 includes an operator input panel 38. With reference to FIG. 2, the face of the control panel 38 includes a data entry keypad 40, a function select keypad 42, and a display 44. The data entry keypad 40 is used for entering data used for controlling operation of the machine 38. The function select keypad 42 is used for selecting functions having parameters to be varied using the data entry keypad 40. The display 44 provides a multi-line display showing current setup parameters.

With reference to FIG. 4, the elements relevant to operation at the sheet feeding end 22 are illustrated in greater detail, the remaining portions of the machine 20 being omitted for clarity.

The sheet feeder 32 includes a pivot rod 46 operatively connected to the printing or duplicating machine 20 for pivotal movement thereto about an axis represented by a line 48. The pivot rod 46 is connected via opposite end brackets 50 and 52 to a cross bar 54. The cross bar 54 is parallel to the pivot rod 46. The four suction feet 34 are axially spaced from one another and connected to the cross bar 54 via adjustable brackets 56 as is conventional. Each suction foot 34 is hydraulically connected via a conduit or hose 58, which is partially schematically illustrated, to a vacuum release valve 60. The vacuum release valve includes an actuator 62 which can be actuated by an arm 63 connected to the pivot rod 46. The vacuum release valve 60 is hydraulically connected via a conduit or hose 64 to a vacuum pump 66. First and second bleed valves 68 and 70 are connected in line in the conduit 64. The vacuum pump 66 may develop, for example, vacuum pressure on the order of 110 to 114 lbs.

In order to control movement of the suction feeder 32, a drive motor 72 is connected via a belt 74 to a driven pulley 76. The driven pulley 76 is connected to an axle 78 driving a crank 80. The crank 80 comprises a wheel 82 to which a first rod 84 is pivotally connected to an offset position 86. The other end of the rod 84 is connected via a pivot link 88 to a second rod 90. The second rod 90 is reciprocally movable responsive to operation of the motor 72. An opposite end of the second rod 90 is connected to a cam 92. The cam 92 is pivotally connected to the machine as at 94. The cam 92 includes an inclined upper surface 96 which supports a roller 98 connected to an arm 100 coupled to the pivot rod 46. Reciprocal movement of the second arm 90 produces reciprocal pivotal movement of the cam 92 about the axis at connection 94.

Operation of the suction feeder 32 will now be described with reference also to FIGS. 5 and 6.

As discussed above, the suction feeder 32 is operable to feed sheets S seriatim from the tray 28 to the conveyor 30. This action is done by movement of the suction feeder 32 between a lift position, see FIG. 5, and a drop position, see FIG. 6. Movement between such positions is coordinated with overall operation of the machine via suitable gearing mechanisms (not shown) so that sheets are delivered at timed intervals to coincide with operative positions of the printing couple 24.

The feed cycle beings at the lift position depicted in FIG. 5 wherein the suction feet 34 are positioned immediately above the top sheet S. Vacuum pressure at the feet 34 lifts the uppermost sheet S. At this position, the second arm 90 is in its rightmost position as shown in the drawing with the roller 98 rested in a flat portion 102 of the cam surface 96. Subsequent movement of the crank 80 causes the second arm 90 to move to the left, as viewed in FIGS. 4–6, pivoting the cam 92 in the counter-clockwise direction. Such movement causes the roller 98 to move up the inclined cam surface 96 to a peak portion 104. This movement causes the pivot rod 46 to pivot in a clockwise direction about its axis 48 causing the arms 50 and 52, and thus connecting rod 54 and suction feet 34 to move upwardly to the drop position adjacent the conveyor 30, as shown in FIG. 6. At the drop position, the release arm 63 engages the vacuum release actuator 62 to provide an open in the conduit 64 to release vacuum from the suction feet 34. Release of the vacuum causes the sheet S to be dropped by the suction feeder 32 where it is then drawn by the conveyor 30 to be printed necessary. Particularly, and with reference to FIG. 6, the sheet S is illustrated in phantom in the vacuum on position and in solid line in the vacuum release or off position.

In accordance with the invention, one or more of the bleed valves 68 and 70 can be controlled to automatically vary vacuum applied at the suction feet 34 according to weight of stock to be printed on.

With reference to FIG. 7, the bleed valve 68 is illustrated. The bleed valve 68 comprises a housing 106 supporting a valve body 108 using a washer 110 and ring retainer 112. A plunger 114 passes through the valve body 108 and extends into the housing 106 at a connecting end 116. The connecting end 116 receives a pin 118 connected to a link 120. The link 120 is connected via a second pin 122 to a solenoid 124 mounted via fasteners 126 within the housing 106.

Figure 8:
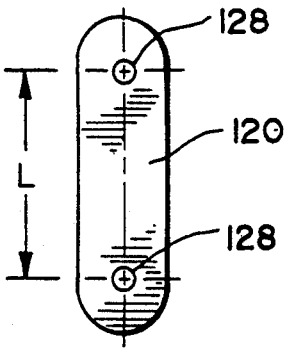
FIG. 8 is a plan view of a linking mechanism of the valve of FIG. 7.

The valve body 108 includes ports labelled A, B and C. In a normal position, with the solenoid 124 deenergized, the plunger 114 is positioned to provide a full open passage between the ports A and C, with the port B being effectively closed off. Upon energization, the solenoid 124 lifts the link 120 which in turn lifts the plunger 114. Such lifting movement of the plunger 114 partially opens the port B and partially closes the port C. The amount which the ports B and C are open and closed, respectively, is determined by the amount which the plunger 114 moves. Particularly, and with reference to FIG. 8, the link 120 includes a pair of apertures 128. The apertures 128 receive the pins 118 and 122. Amount of plunger movement is determined by the spacing L between the apertures 128. Thus, according to the particular use of the printing or duplicating machine 20, the link 120 can be selected to vary the amount of vacuum bleed provided by the bleed valve 68.

Although not shown, the second bleed valve 70 is generally similar to the first bleed valve 68, except for the link 120. Particularly, in the illustrated embodiment of the invention, the first bleed valve is configured to bleed a portion of vacuum in the conduit 64, while the second bleed valve 70 is configured to release virtually all of the vacuum in the conduit 64, for reasons discussed below.

With reference also to FIG. 9, a block diagram illustrates the control system for operating the bleed valves 68 and 70. The control system includes a controller block 130 including a CPU 132 connected via a data buss 134 to an interface 136. Although not shown, the CPU 132 includes suitable memory and other circuits as is conventional. The interface 136 connects the control panel 38 to the data buss 134 to receive input commands. The interface 136 also connects a relay board 138 to the data buss 134. The relay board 138 includes suitable pilot relays for switching higher currents necessary for operating the solenoids of the bleed valves 68 and 70.

With reference also to FIG. 10, a hydraulic schematic illustrates hydraulic connections of the suction control system.

The vacuum pump 66 is connected via a first conduit portion 64-1 to port A of the first bleed valve 68. Port C of the first bleed valve 68 is connected via a second conduit portion 64-2 to port A of the second bleed valve 70. Port C of the second bleed valve 70 is connected via a third conduit portion 64-3 to the hose 58 and thus the suction feet 34. Port B of each valve 68 and 70 is a bleed port which is open to atmosphere.

With the solenoids of both bleed valves 68 and 70 deenergized, 100% of vacuum developed by the vacuum pump, ignoring losses, is evident at the suction feet 34. Energization of the solenoid of the first bleed valve 68 bleeds a selected amount of vacuum which, in the illustrated embodiment, comprises a maximum of 50% vacuum. Energization of the solenoid of the second bleed valve 70 bleeds all of the vacuum from the conduit 64.

In order to control operation of the bleed valves 68 and 70 the CPU 132 is operated in accordance with a control program so that it automatically operates the bleed valves 68 and 70 to adjust vacuum at the suction feet 34 responsive to relative weight of any given sheet as identified by input transferred from any input media, such as a control program or the operator input panel 38.

Figure 11:
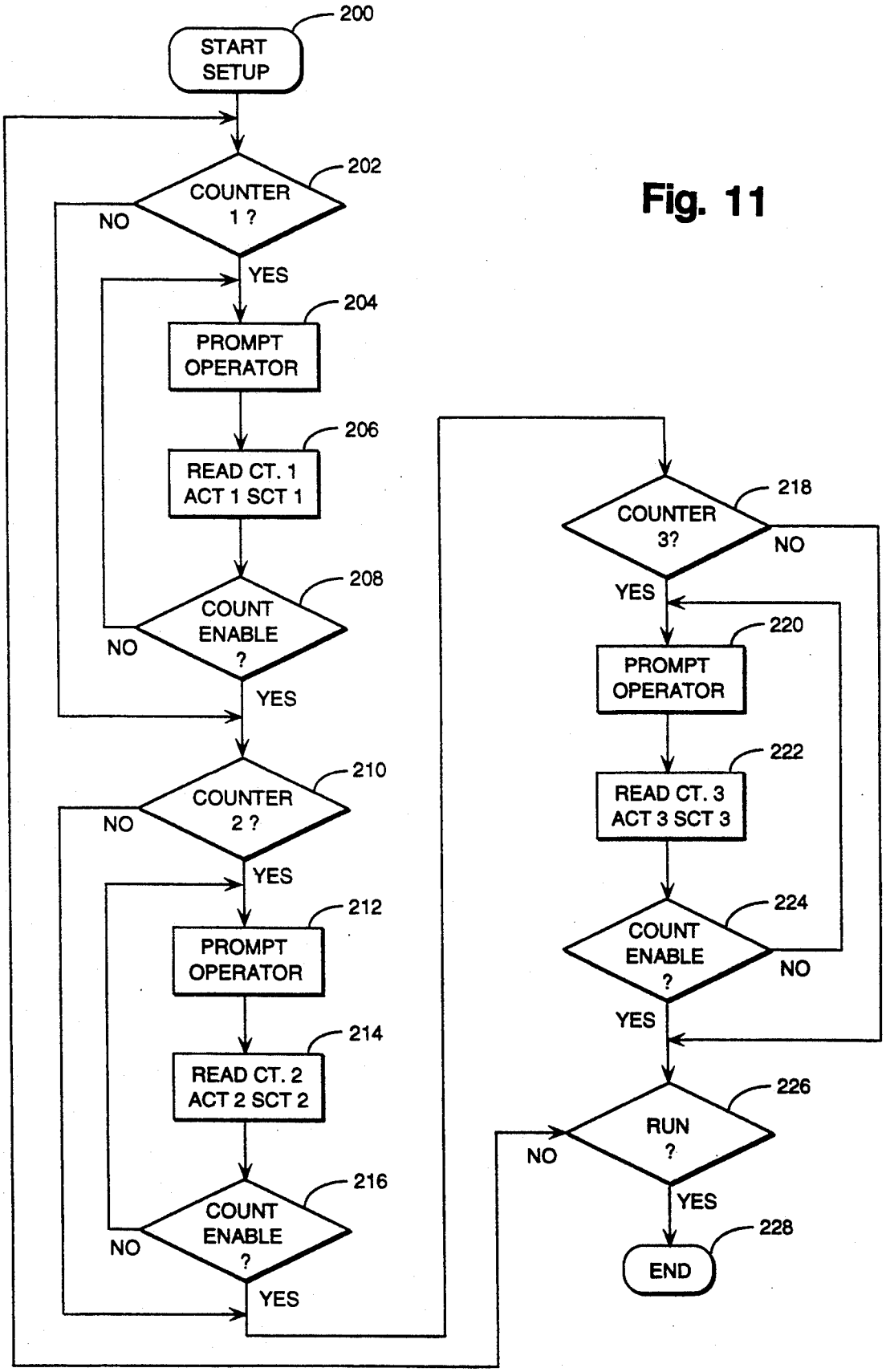
FIG. 11 is a logic flow diagram illustrating a setup program for the CPU of FIG. 9 for setting up operation of the suction control system.

With reference to FIG. 11, a logic flow diagram illustrates a control program run by the CPU 132 for inputting setup parameters for defining operation of the machine 20. With reference also to FIG. 3, the function select keypad 42 includes keys labelled COUNTER ONE, COUNTER TWO, COUNTER THREE and COUNT ENABLE. These keys are used to set up three separate counters for effecting printing of three jobs during one run, or subdividing a single job into multiple batches, as necessary or desired. Logic control begins at a start block 200 and proceeds to a decision block 202 which determines whether or not the COUNTER ONE button has been depressed. If so, then the operator is prompted at a block 204 as by displaying a message on the display 44. In the illustrated embodiment, the following operator prompt is displayed:

| | |
|---|---|
| COUNTER | XX |
| NUMBERING OFF | |
| VAR FROM CT# | YY |
| ADJ UP TO CT# | ZZ |

In the prompt, the first line indicates whether the first, second or third counter has been selected for input. The operator then enters any select number using the data entry keypad 40 to set the value XX for the first counter, representing the total number of sheets to be printed during the job or batch. The second line designates if numbering is set off or on. Numbering provides incremental numbering on successive sheets, such as in a check printing operation. The third line is used to indicate the count value for which vacuum adjustment is to commence as by the operator entering data for the digits YY. The last line indicates the count ZZ to be filled in by the operator for the last sheet to use the adjusted vacuum. In the illustrated example, the first counter is set up to print eleven sheets with the first six sheets being a normal weight stock. Vacuum is adjusted from sheets seven to ten, indicating that the first bleed valve 68 should be energized to decrease the vacuum as the seventh through tenth sheets are a lighter stock. Thereafter, the eleventh sheet would be an average or heavier weight stock and full vacuum will be applied.

As the operator enters the values, the same are read into memory at a block 206 wherein the value XX is stored in a register CT1, the value YY in a register ACT1, and the value ZZ in a register SCT1. A decision block 208 then determines whether or not the COUNT ENABLE key has been depressed indicating that the operator has completed entering data for the first counter. If not, control returns to the block 204.

Once the COUNT ENABLE key is depressed, or if COUNTER ONE was not selected at block 202, then control advances to a decision block 210 which determines if the COUNTER TWO key was depressed. If the COUNTER TWO key was depressed, then the operator is prompted at a block 212, similar to the block 204 except the display 44 indicates "second counter". Thereafter, the values XX, YY and ZZ are stored in register CT2, ACT2, or SCT2 at a block 214. A decision block 216 then determines if the COUNT ENABLE key has been depressed and, if not, returns to the block 212.

Figure 12:
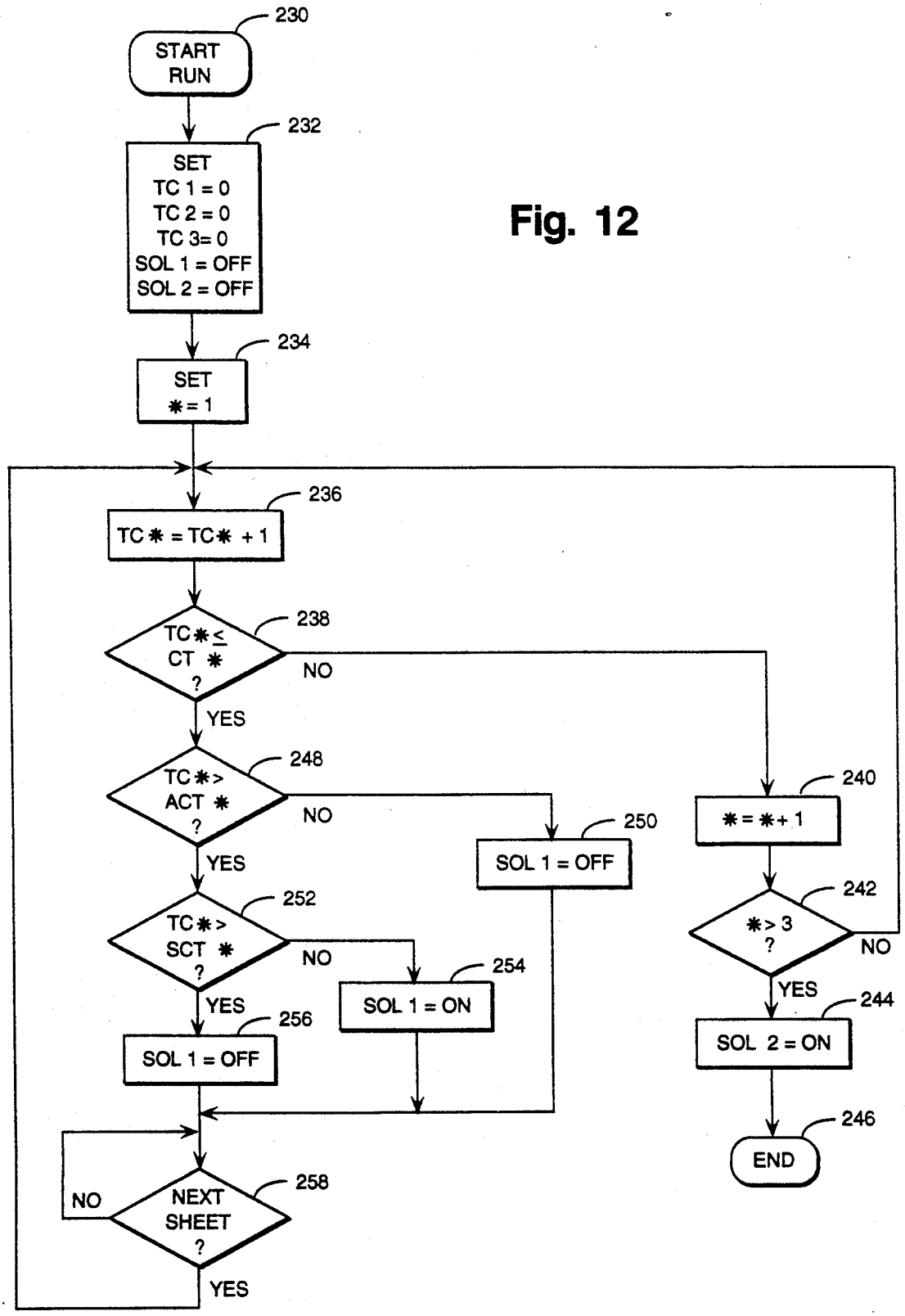
FIG. 12 is a logic flow diagram of a run program implemented by the CPU of FIG. 9 for the suction control system.

If the COUNT ENABLE key is depressed, or if the COUNTER TWO key was not depressed at the block 210, then control advances to a decision block 218 which determines if the COUNTER THREE key has been depressed. If so, then control proceeds to blocks 220, 222 and 224 which function similarly to the blocks 212, 214 and 216, except for being related to the third counter. From block 224, or if COUNTER THREE was not selected at the block 218, then a decision block 226 determines if the machine has been initiated to begin the printing or duplicating operation. This operation is selected independently of the operator control panel 38 and the CPU 132 is set up to receive a flag when run has been initiated. If run has not been initiated, then control returns to the block 202. If the run operation has been initiated, then the setup routine ends and control advances to a run routine illustrated in FIG. 12.

During the run routine, the CPU 132, see FIG. 9, keeps track of operation of all of the counters and determines when the bleed valve 68 or 70 should be operated.

The run operation is started at a node 230 which immediately advances to a block 232 which sets registers TC1, TC2 and TC3 all equal to zero and also turns off registers SOL1 and SOL2, representing the status of the bleed valves 68 and 70, respectively. These parameters are only set at the beginning of the run routine. Thereafter, control advances to a block 234 which sets a value * equal to one. Since the run routine is the same for each counter, a single loop is illustrated, with the * value representing the particular counter operation being implemented.

Control for a job begins at a block 236 which increments a total count register TC* (the asterisk being replaced by its current number) by one. Thus during the first pass for the first counter, the register TC1 would be set to one, indicating presence of the first sheet in the stack to be printed. A decision block 238 determines if the register TC* is less than or equal to the register CT*. This block determines if the total count for the run is less than or equal to the operator selected count total XX for the run. If not, then the run is complete and control proceeds to a block 240 which increments the asterisk value by one. A decision block 242 then determines if the asterisk value is greater than three, indicating that all three runs have been completed, and if so proceeds to a block 242 which sets the SOL2 register on to energize the second bleed valve 70. The second bleed valve 70 is energized at the end of the run to completely shut off vacuum from the suction feet 34 so that no more sheets are lifted from the stack. The routine then ends at a node 246.

Returning to the decision block 238, if the register value TC* is less than or equal to the value of CT*, then control advances to a decision block 248. At the decision block 248, control determines if the value TC* is greater than the value ACT*. This determines whether or not the number of the next sheet to be delivered is greater than the number at which vacuum adjustment should begin. If not, then control advances to a block 250 which sets the register SOL1 to off to maintain the first bleed valve 68 deenergized. If the decision at the block 248 is in the affirmative, then control advances to a decision block 252 which determines whether the value TC* is greater than the value SCT*. This determines whether or not the next sheet to be delivered is greater than the value at which adjustment should cease. If not, then control advances to a block 254 which sets the register SOL1 to on to energize the first bleed valve 68 to provide a decreased vacuum at the suction feet 34. If the decision at the block 252 is in the affirmative, then at a block 256 the register SOL1 is set to off. From any of the blocks 250, 254, 256, control advances to a decision block 258 which determines whether or not the system is ready to feed the next sheet. Control waits at this block until the next sheet is ready to be delivered, as determined in any known manner, and then control returns to the block 236, discussed above.

After the asterisk has been incremented at the block 240, if the decision block 242 determines that the value of the asterisk is not greater than three, then control also returns to the block 236 to begin a cycle of operation for the next counter. For example, in the illustrated embodiment, the control will cycle through three times, once each for COUNTER ONE, COUNTER TWO and COUNTER THREE.

As is apparent, the illustrated system could be used to run three distinct jobs as by using each of the three counters independently during a single run. Alternatively, if the stack is for a single job with multiple positions of different weight stock, then the three counters can be used to provide sequential operation to provide three distinct adjustment periods during a single run.

Although the disclosed system illustrates use of a single bleed valve for adjusting vacuum to account for weight of sheets, multiple valves providing distinct amounts of bleed could be utilized to provide multiple levels of automatic control. Alternatively, a modulating type bleed valve could be used to provide more precise control of the amounts of bleed to account for situations in which numerous different weights of stock are providing during a run.

Moreover, alternative input means could be used for determining when adjustment is to be made. For example, the adjustment values could be preprogrammed, or default values could be used, or an appropriate sensor could be used for determining the weight of an given sheet in the stack.

The illustrated embodiment of the invention is illustrative of the broad inventive concepts comprehended hereby.

We claim:

1. In a printing, duplicating or like machine which includes a vacuum suction feeder for feeding sheets seriatim to a printing couple of the machine, the sheets being provided in a stack which may comprise both relatively low weight stock sheets and relatively high weight stock sheets, a suction control system comprising:

a source of vacuum;

a conduit connecting said source of vacuum to said suction feeder;

input means for determining if a next successive sheet in the stack is a relatively low weight stock sheet or a relatively high weight stock sheet; and control means operatively associated with any one of said suction feeder, source of vacuum or conduit for automatically adjusting vacuum at said suction feeder responsive to relative weight of the next successive sheet determined by said input means, said control means adjusting vacuum to provide higher vacuum for a relatively high weight stock sheet and a lower vacuum for a relatively low weight stock sheet.

2. The suction control system of claim 1 wherein said input means comprises an operator panel.

3. The suction control system of claim 1 wherein said control means comprises a bleed valve coupled in said conduit.

4. The suction control system of claim 3 wherein said control means comprises a solenoid linked to said bleed valve for operating the same.

5. The suction control system of claim 3 wherein said bleed valve reduces vacuum applied at said suction feeder by a preselected amount.

6. The suction control system of claim 5 wherein said bleed valve includes a plunger and plunger movement is selected to provide said preselected amount of vacuum reduction.

7. In a printing, duplicating or like machine which includes a vacuum suction feeder for feeding sheets seriatim to a printing couple of the machine, the sheets being provided in a stack which may comprise both relatively low weight stock sheets and relatively high weight stock sheets, a suction control system comprising:

a source of vacuum;

a conduit connecting said source of vacuum to said suction feeder;

input means for determining relative weight of any given sheet in a stack, wherein said input means comprises a presettable counter means for entering a count value representing a quantity of sheets at a relatively high weight and a quantity of sheets at a relatively low weight; and control means operatively associated with any one of said suction feeder, source of vacuum or conduit for automatically adjusting vacuum at said suction feeder responsive to relative weight of any given sheet determined by said input means.

8. In a printing, duplicating or like machine which includes a vacuum suction feeder for feeding sheets seriatim to a printing couple of the machine, the sheets being provided in a stack which may comprise both relatively low weight stock sheets and relatively high weight stock sheets, a suction control system comprising:

a source of vacuum;

a conduit connecting said source of vacuum to said suction feeder;

a vacuum release valve in said conduit for releasing vacuum to said suction feeder to release a sheet;

means for operating said release valve after each sheet is fed to the printing couple of the machine;

input means for identifying if a next successive sheet in the stack is a relatively low weight stock sheet or a relatively high weight stock sheet;

a bleed valve in said conduit operable to bleed a controlled amount of vacuum from said conduit; and control means operatively coupled to said input means and said bleed valve for automatically operating said bleed valve to decrease vacuum at said suction feeder responsive to a next successive sheet identified by said input means being a relatively low weight stock sheet.

9. The suction control system of claim 8 wherein said input means comprises an operator panel.

10. The suction control system of claim 8 wherein said control means comprises a solenoid linked to said bleed valve for operating the same.

11. The suction control system of claim 8 wherein said bleed valve records vacuum applied at said suction feeder by a select amount.

12. The suction control system of claim 11 wherein said bleed valve includes a plunger and plunger movement is selected to provide said select amount of vacuum reduction.

13. In a printing, duplicating or like machine which includes a vacuum suction feeder for feeding sheets seriatim to a printing couple of the machine, the sheets being provided in a stack which may comprise both relatively low weight stock sheets and relatively high weight stock sheets, a suction control system comprising:

a source of vacuum;

a conduit connecting said source of vacuum to said suction feeder;

a vacuum release valve in said conduit for releasing vacuum to said suction feeder to release a sheet;

means for operating said release valve after each sheet is fed to the printing coupled of the machine;

input means for identifying relative weight of any given sheet in a stack, wherein said input means comprises a presettable counter means for entering a count vale representing a quantity of sheets at a relatively high weight and a quantity of sheets at a relatively low weight;

a bleed valve in said conduit operable to bleed a controlled amount of vacuum from said conduit; and control means operatively coupled to said input means and said bleed valve for automatically operating said bleed valve to adjust vacuum at said suction feeder responsive to relative weight of any given sheet identified by said input means.

14. In a printing, duplicating or like machine which includes a vacuum suction feeder for feeding sheets seriatim to a printing couple of the machine, the sheets being provided in a stack which may comprise both relatively low weight stock sheets and relatively high weight stock sheets, a suction control system comprising:

a source of vacuum;

a conduit connecting said source of vacuum to said suction feeder;

operator input means for identifying if a next successive sheet in the stack is a relatively low weight stock sheet or a relatively high weight stock sheet;

a solenoid operated bleed valve in said conduit operable to bleed a select amount of vacuum from said conduit;

a programmed processor control means connected to said input means and said solenoid for automatically operating said solenoid to adjust vacuum at said suction feeder responsive to relative weight of any given sheet identified by said input means, said control means adjusting vacuum to provide higher vacuum for a relatively high weight stock sheet and a lower vacuum for a relatively low weight stock sheet.

15. The suction control system of claim 14 wherein said control means includes a programmed counter and said input means sets values in said counter representing relative weight of any given sheet in a stack.

16. The suction control system of claim 14 including a second solenoid operated bleed valve in said conduit operable to release vacuum from said conduit.

17. The suction control system of claim 16 wherein said second solenoid is connected to said programmed processor control means which automatically operated said second solenoid to release vacuum at said suction feeder automatically upon completion of a job.

18. In a printing, duplicating or like machine which includes a vacuum suction feeder for feeding sheets seriatim to a printing couple of the machine, the sheets being provided in a stack which may comprise both relatively low weight stock sheets and reactively high weight stock sheets, a suction control system comprising:

a source of vacuum;

a conduit connecting said source of vacuum to said suction feeder;

operator input means for identifying relative weight of any given sheet in a stack;

a solenoid operated bleed valve in said conduit operable to bleed a select amount of vacuum from said conduit;

a programmed processor control means connected to said input means and said solenoid for automatically operating said solenoid to adjust vacuum at said suction feeder responsive to relative weight of any given sheet identified by said input means, wherein said control means includes a plurality of programmed counters and said input means sets values in each said counter representing relative weight of any given sheet in a stack.

* * * * *